US010532568B2

(12) United States Patent
Korthuis et al.

(10) Patent No.: US 10,532,568 B2
(45) Date of Patent: Jan. 14, 2020

(54) FIRE PULSE WIDTH ADJUSTMENT

(71) Applicant: HEWLETT-PACKARD DEVELOPMENT COMPANY, L.P., Houston, TX (US)

(72) Inventors: Vincent C. Korthuis, Corvallis, OR (US); Eric T Martin, Corvallis, OR (US); Michael W. Cumbie, Albany, OR (US); Scott A Linn, Corvallis, OR (US); Pere Esterri, Sant Cugat del Valles (ES)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 16/061,215

(22) PCT Filed: Apr. 14, 2016

(86) PCT No.: PCT/US2016/027633
§ 371 (c)(1),
(2) Date: Jun. 11, 2018

(87) PCT Pub. No.: WO2017/180142
PCT Pub. Date: Oct. 19, 2017

(65) Prior Publication Data
US 2019/0030888 A1 Jan. 31, 2019

(51) Int. Cl.
*B41J 2/045* (2006.01)

(52) U.S. Cl.
CPC ..... *B41J 2/04591* (2013.01); *B41J 2/0458* (2013.01); *B41J 2/04543* (2013.01); *B41J 2/04598* (2013.01)

(58) Field of Classification Search
CPC .. B41J 2/04591; B41J 2/04543; B41J 2/0458; B41J 2/04598
See application file for complete search history.

(56) References Cited

U.S. PATENT DOCUMENTS

| | | | | |
|---|---|---|---|---|
| 5,107,276 | A | 4/1992 | Kneezel et al. | |
| 5,677,577 | A | 10/1997 | Barbehenn et al. | |
| 5,975,667 | A * | 11/1999 | Moriguchi | B41J 2/0458 347/10 |
| 6,260,959 | B1 | 7/2001 | Takahashi | |
| 6,827,413 | B1 | 12/2004 | Kawatoko et al. | |
| 6,869,157 | B2 | 3/2005 | Miyakoshi et al. | |
| 8,947,734 | B1 | 2/2015 | Marshall et al. | |
| 2003/0016258 | A1 * | 1/2003 | Anderson | B41J 2/04506 347/14 |

(Continued)

*Primary Examiner* — Bradley W Thies
(74) *Attorney, Agent, or Firm* — HP Inc. Patent Department

(57) ABSTRACT

First electronics may determine a count of bubble jet resistors to be fired by a fire pulse group. A fire pulse generator may generate a fire pulse train for bubble jet resistors, the fire pulse train comprising a precursor pulse and a firing pulse separated by a dead time. Second electronics may adjust a width of the fire pulse for the bubble jet resistors of the fire pulse group by maintaining a first edge of the fire pulse relative to the precursor pulse and adjusting a second edge of the fire pulse relative to the precursor pulse based upon the determined count for the fire pulse group.

20 Claims, 4 Drawing Sheets

(56) References Cited

U.S. PATENT DOCUMENTS

| | | | | |
|---|---|---|---|---|
| 2005/0116975 | A1* | 6/2005 | Kasai | B41J 2/04541 347/10 |
| 2008/0180474 | A1 | 7/2008 | Jeon et al. | |
| 2010/0328391 | A1* | 12/2010 | Martin | B41J 2/04528 347/14 |

* cited by examiner

FIRE PULSE WIDTH ADJUSTMENT

BACKGROUND

Bubble jet devices selectively eject drops of liquid by passing electrical current through a resistor to generate heat to vaporize the liquid and create a bubble that ejects surrounding liquid through a nozzle or along a passage. Such bubble jet devices are fired in response to electrical signal pulses that control the duration during which the electrical current is applied to the resister.

DETAILED DESCRIPTION OF EXAMPLES

Figure 1:
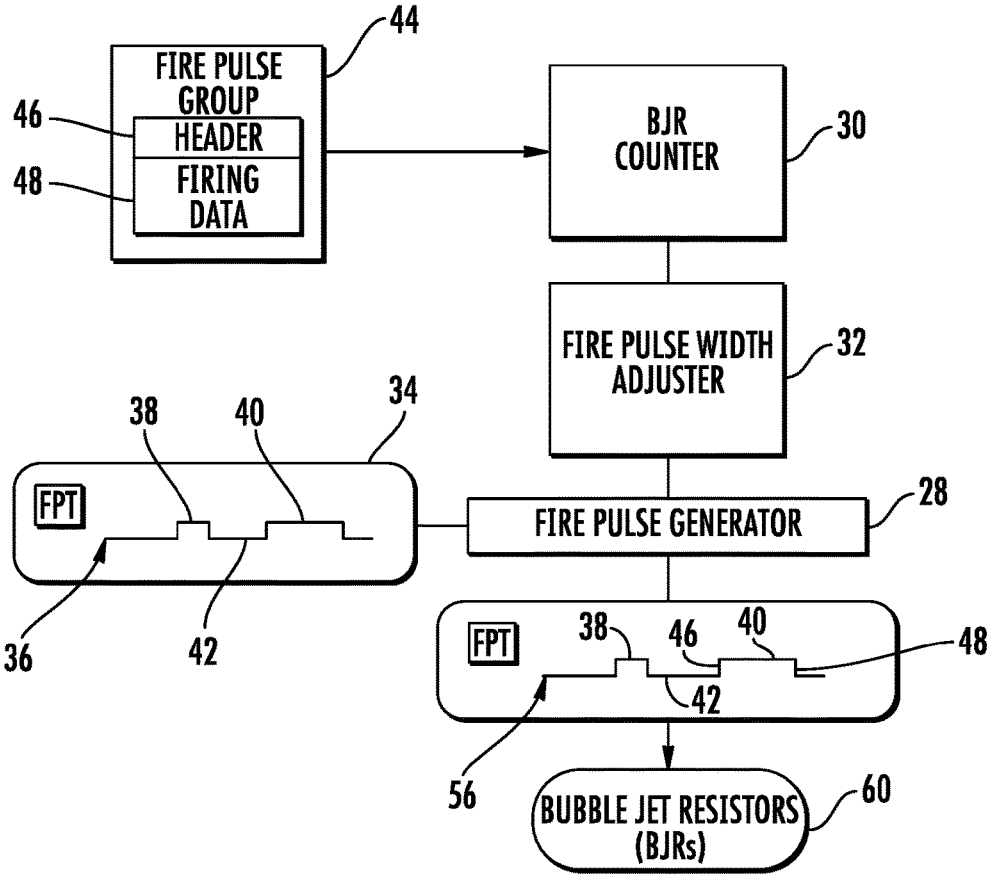
FIG. 1 is a schematic diagram of an example bubble jet device.

FIG. 1 schematically illustrates an example bubble jet device 20. Bubble jet device 20 selectively eject drops of liquid by passing electrical current through a resistor to generate heat to vaporize the liquid and create a bubble that ejects surrounding liquid through a nozzle or along a passage. Bubble jet device 20 utilizes electrical signal pulses that control the duration during which the electrical current is applied to the resister.

To control the application of electrical current to each bubble jet resistor, a fire pulse generator generates a fire pulse train. Each fire pulse train comprises at least one precursor pulse and a firing pulse separated by a dead time. The precursor pulse is an electrical signal pulse that causes electrical current to be passed through the resister for a duration that is insufficient to produce sufficient heat so as to vaporize the liquid. Instead, the precursor pulse causes electrical current to be passed through the resister so as to produce a lesser amount of heat that preheats the liquid adjacent the resister. The dead time or soak time terminates the application of electrical current to the resister, allowing time for the liquid to absorb heat from the prior precursor pulse. The firing pulse is an electrical signal pulse that causes electrical current to be passed through the resister for a sufficient duration such that the amount of heat output by the resister raises the temperature of the adjacent liquid above its nucleation temperature to vaporize the adjacent preheated liquid and to create the bubble that ejects the drop of the liquid through a nozzle.

Control over which bubble jet resistors or which nozzles eject liquid at any one moment of time is dictated by a fire pulse group. A fire pulse group comprises a series of data bits comprising a header which identifies the proceeding bits as firing data. The proceeding bits that constitute the firing data identify which bubble jet resistors are to be concurrently fired at a particular moment in time. If the particular resistor is identified in the fire pulse group as a resistor to be fired, the fire pulse train generated by the fire pulse generator is transmitted to the resistor(s) to be fired and controls the application of electrical current across the resister to eject liquid.

As will be described hereafter, bubble jet device 20 counts the number of bubble jet resistors that are to be fired at any one time pursuant to the fire pulse group. Bubble jet device 20 then adjusts a width of the fire pulse in the fire pulse train based upon the determined number or count of resistors to be fired. By varying the width of each fire pulse based upon the determined number or count of bubble jet resistors to be fired as part of the fire pulse group, bubble jet device 20 may dynamically compensate for parasitic losses that may occur when a large number of bubble jet resistors are being concurrently fired (a high print density) while, at the same time, dynamically reduce the application of excess energy when a small number of bubble jet resistors are being concurrently fired, improving performance by increasing firing efficiency and reducing kogation and print head overheating. Accounting for parasitic losses may also reduce the cost of the energy delivery system in a printer, as higher parasitics (lower cost) may be tolerated.

Bubble jet device 20 adjusts the width of each fire pulse in the fire pulse train for the particular fire pulse group by maintaining a first edge of the fire pulse relative to the precursor pulse and adjusting a second edge of the fire pulse relative to the precursor pulse based upon a determined number or count of bubble jet resistors being fired as part of the fire pulse group. As a result, the control or adjustment of the fire pulse of the fire pulse train for the individual fire pulse group may be more effectively achieved at a lower cost.

As shown by FIG. 1, bubble jet device 20 comprises fire pulse generator 28, a bubble jet resistor counter 30 and a fire pulse width adjuster 32. Fire pulse generator 28 comprises electronics that control the supply of electrical current to bubble jet resistors by outputting signal pulses pursuant to a default fire pulse train 36. FIG. 1 schematically illustrates an example fire pulse train 36 which is defined by contents of register 34 or other memory accessible by fire pulse generator 28. The example fire pulse train 36 comprises a precursor pulse 38 and a fire pulse 40 separated by a soak time or dead time 42. In one implementation, the fire pulse 40 of train 36 is set to deliver "over energy", a duration of sufficient length to compensate for voltage drops during those print jobs in which a large number of the bubble jet resistors are fired, such as the maximum number of bubble jet resistors that may be fired pursuant to a fire pulse group. It should be understood that the illustrated fire pulse train 36 is only an example, wherein the relative timing and duration of each of the precursor pulses 38, firing pulses 40 and dead times 42 may vary.

Bubble jet resistor counter 30 comprises electronics that determines a number or count of bubble jet resistors to be concurrently fired pursuant to fire pulse group 44. In one implementation, fire pulse group 44 is in the form of a bit stream comprising a header 46 and firing data 48. Header 46 comprises those bits that identify the proceeding bits as the firing data. Firing data 48 comprises those bits that identify what individual resistors are to be fired at a particular moment in time. For example, firing data 48 may comprise a string of bits corresponding to bubble jet resistors, wherein each "1" in the fire pulse group bit stream represents a firing bubble jet resistor in the data section of the fire pulse group. In such an implementation, bubble jet resistor counter 30 comprises a digital counter that counts each occurrence of "1". In other implementations, other mechanisms may be utilized to count the number of bubble jet resistors fired pursuant to a particular fire pulse group.

Fire pulse width adjuster 32 comprises electronics that adjusts a width of the fire pulse 40 for each bubble jet resistor of a fire pulse group 34 based upon the number or count of bubble jet resistors to be fired pursuant to the fire pulse group 34. Fire pulse width adjuster 32 adjusts the width of each fire pulse 40 (from the original default width of the fire pulse 40 in the default fire pulse train 36) by maintaining a first edge of the fire pulse 40 relative to the precursor pulse 38 and by adjusting a second edge of the fire pulse 40 relative to the precursor pulse 38. In other implementations, the total energy delivered may alternatively or additionally be adjusted by modifying the precursor edges or dead time width.

In one implementation, fire pulse width adjuster 32 determines the fire pulse width for each fire pulse of each fire pulse group based upon the total number of bubble jet resistors to be fired pursuant to each fire pulse group using a determination protocol. In one implementation, the fire pulse width determination protocol is selected from a group of determination protocols consisting of: applying a nonlinear equation based upon the determined count and consulting a lookup table based upon the determined count; and inputting two points in a register space to apply a linear equation based upon the determined count.

In one implementation, the nonlinear equation is determined through the calculation of a linear line from two set points which are loaded into register space and are determined experimentally. One such set point is based upon a minimum possible number of bubble jet resistors firing for a fire pulse group with the other set point being based upon a maximum possible number of bubble jet resistors firing for a fire pulse group. From such set points, a linear equation is used to calculate a percent energy adjustment.

For example, in one implementation where 1 uj is required to fire a 1000 Ohm resistor, a pulse width may be determined according to the following equation: $1\ uj=V^2/R*pulse\ width \rightarrow pulse\ width=1\ uj*R/V^2$. In implementations where a power supply provides 30V for firing voltage and wherein it is experimentally determined that 2V of parasitic losses occur when a single resistor is firing, the pulse width may be determined by the equation: $pulse\ width=1\ uj*1000/28^2=1.3$ us. In such an implementation, when 50% of the resistors are firing simultaneously and it is experimentally determined that 5V of parasitic losses occur, the pulse width required may be determined by the equation: $pulse\ width=1\ uj*1000/20^2=1.6$ us. In such an implementation, the fire pulse width adjuster would provide fire pulse adjustment such that when a single resistor is firing, a pulse width of 1.3 us will be provided to the resistor, whereas when 50% of the resistors are firing, 1.6 us may be provided. These two pulse widths serve as two set points for the calculation of a linear line, the equation of which is utilized to determine pulse width adjustments when other percentages of resistors are to be fired. In other implementations, the relationship between number of resistors firing and pulse width may be described by a non-linear equation, look-up table, or some other method. Furthermore, considerations such as temperature, firing resistance, firing architecture or other print conditions may also be factored in when determining pulse width adjustments.

FIG. 1 schematically illustrates an example adjusted fire pulse train 56 resulting from the modification of the default fire pulse train 46 by fire pulse width adjuster 32, wherein fire pulse width adjuster 32 adjusts the width of the fire pulse 40. In particular, fire pulse width adjuster 32 outputs signals causing fire pulse generator 28 to change the length of the fire pulse 40 based upon the determined count for the number of bubble jet resistors in the particular fire pulse group 44. Fire pulse width adjuster 32 adjusts the width of the fire pulse 40 by maintaining a first edge of the fire pulse relative to the precursor pulse 38 while adjusting a second edge of the fire pulse relative to the precursor pulse.

In one implementation, fire pulse width adjuster 32 adjusts the width of fire pulse 40 by adjusting the relative timing or positioning of the leading-edge 46 of fire pulse 40 relative to the precursor pulse 38. At the same time, the trailing edge 48 of fire pulse 40 is maintained, unaltered in time relative to precursor pulse 38. In other words, adjuster 32 adjusts the timing at which firing pulse 40 is initiated, as compared to the original timing at which firing pulse 40 was to be initiated pursuant to the default fire pulse train 36. Adjuster 32 does not alter the timing at which firing pulse 40 is terminated or ended as compared to the original timing at which firing pulse 40 was to be ended pursuant to the default fire pulse train 36.

For example, in one implementation, in response to receiving signals from bubble jet resistor counter 30 indicating that the number of bubble jet resistors to be fired pursuant to the received fire pulse group 44 is below a predetermined threshold, fire pulse width adjuster 32 may shorten the duration of fire pulse 40 of the default fire pulse train 36 by shifting the leading-edge 46 of fire pulse train 40 to the right, lengthening dead time 42, to output modified fire pulse train 56. In response to receiving signals from bubble jet resistor counter 30 indicating that the number of bubble jet resistors to be fired pursuant to the received fire pulse group 44 is above a predetermined threshold, fire pulse with adjuster 32 may keep the default duration of the fire pulse 40 of the default fire pulse train 36 or may lengthen the duration of fire pulse 40 of the default fire pulse train 36 by shifting the leading edge 46 of fire pulse train 40 to the left, shortening dead time 42. In some implementations, fire pulse width adjuster 32 may employ multiple different predefined thresholds, wherein fire pulse with adjuster 32 differently adjusts the duration of fire pulse 40 from the default duration of fire pulse 40 in default fire pulse train 36 based upon which of the multiple thresholds is satisfied by the value of the count output by bubble jet resistor counter 30 and indicating the number of bubble jet resistors to be fired pursuant to the particular fire pulse group 44.

The modified fire pulse train 56 output by fire pulse generator 28 is transmitted to each of the bubble jet resistors 60 that are to be fired at the same time pursuant to the firing data 48 of fire pulse group 44. In such an implementation, because all of the fire pulses 40 for all of the bubble jet resistors of the fire pulse group are adjusted in a similar or identical manner, execution of the multiple fire pulse adjustments is simpler and less costly, utilizing less processing bandwidth or less hardware.

In another implementation, fire pulse width adjuster 32 may adjust the width of fire pulses 40 by adjusting the relative timing or positioning of the trailing edge 48 of fire pulses 40 relative to the precursor pulse 38. At the same time, the leading-edge 46 is maintained unaltered in time relative to precursor pulse 38. In other words, adjuster 32 adjusts the timing at which firing pulses 40 are terminated, as compared to the original timing at which firing pulses 40 were to be terminated pursuant to the default fire pulse train 36. Adjuster 32 does not alter the timing at which firing pulses 40 are initiated as compared to the original timing at which firing pulses 40 were to be initiated pursuant to the original or default fire pulse train 36.

Figure 2:
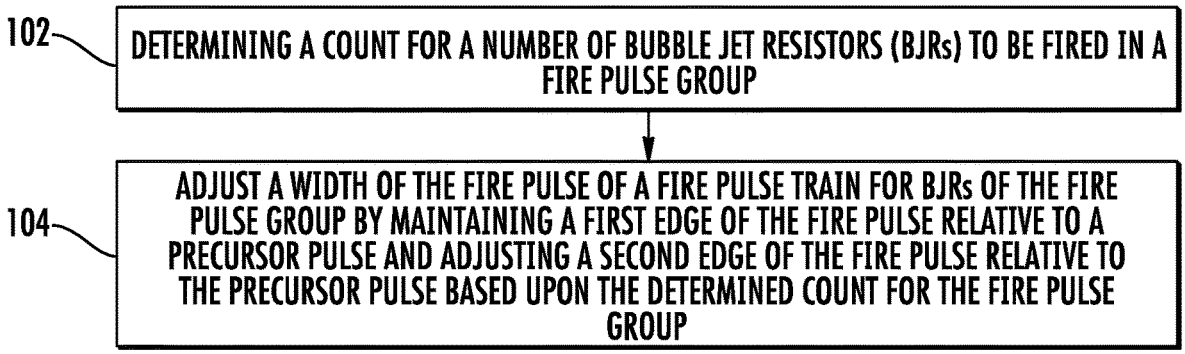
FIG. 2 is a flow diagram of an example method for controlling the firing of bubble jet resistors.

FIG. 2 is a flow diagram of an example method 100 for controlling the firing of bubble jet resistors. For purposes of discussion, method 100 is described as being carried out by bubble jet device 20. In other implementations, method 100 may be carried out by any of the following described printers or other similar bubble jet devices.

As indicated by block 102, bubble jet resistor counter 30 determines a count for the number of bubble jet resistors to be fired in a fire pulse group. In one implementation, fire pulse group 34 is in the form of a bit stream, comprising a header 46 and firing data 48. Header 46 comprises those bits that identify the proceeding bits as the firing data. Firing data 48 comprises those bits that identify what individual bubble jet resistors are to be fired at a particular moment in time. For example, firing data 48 may comprise a string of bits corresponding to bubble jet resistors, wherein each "1" in the fire pulse group bit stream represents a firing bubble jet resistor in the data section of the fire pulse group. In such an implementation, bubble jet resistor counter 30 comprises a digital counter that counts each occurrence of "1". In other implementations, other mechanisms may be utilized to count the number of bubble jet resistors to be fired pursuant to a particular fire pulse group. W As indicated by block 104, fire pulse width adjuster 32 adjusts a width of the fire pulse for each bubble jet resistor of the fire pulse group by maintaining a first edge of the fire pulse relative to a precursor pulse and adjusting a second edge of the fire pulse relative to the precursor pulse based upon the determined count for the fire pulse group. In one implementation, fire pulse width adjuster 32 adjusts the leading-edge of the fire pulse while maintaining the trailing edge of the fire pulse relative to the precursor pulse. In one implementation, fire pulse width adjuster 32 equally adjusts the timing of the leading-edge of each fire pulse for each bubble jet resistor of the fire pulse group based upon the determined count of bubble jet resistors to be fired pursuant to the fire pulse group. In one implementation, fire pulse width adjuster 32 outputs a single adjusted initiation time which is used for each of the fire pulses 40 for each of the bubble jet resistors to be fired as part of the fire pulse group. For example, based upon the determined count for the number of bubble jet resistors to be fired pursuant to the fire pulse group, adjuster 32 may adjust the initiation time T1 that is the same for each of fire pulses 40 to a second different time T2 that is the same for each of fire pulse 40. At the same time, the termination time for each of the fire pulses 40 is maintained relative to the precursor pulse of the fire pulse train, unaltered with respect to the original termination time for the fire pulses in the default fire pulse train 36. In another implementation, fire pulse width adjuster 32 adjusts the trailing edge of the fire pulse with respect to the trailing edge of the fire pulse in the default fire pulse train 36, while maintaining the leading edge of the fire pulse relative to the precursor pulse, not changing the timing of the leading edge of the fire pulse from the timing prescribed by the default fire pulse train 36.

Figure 3:
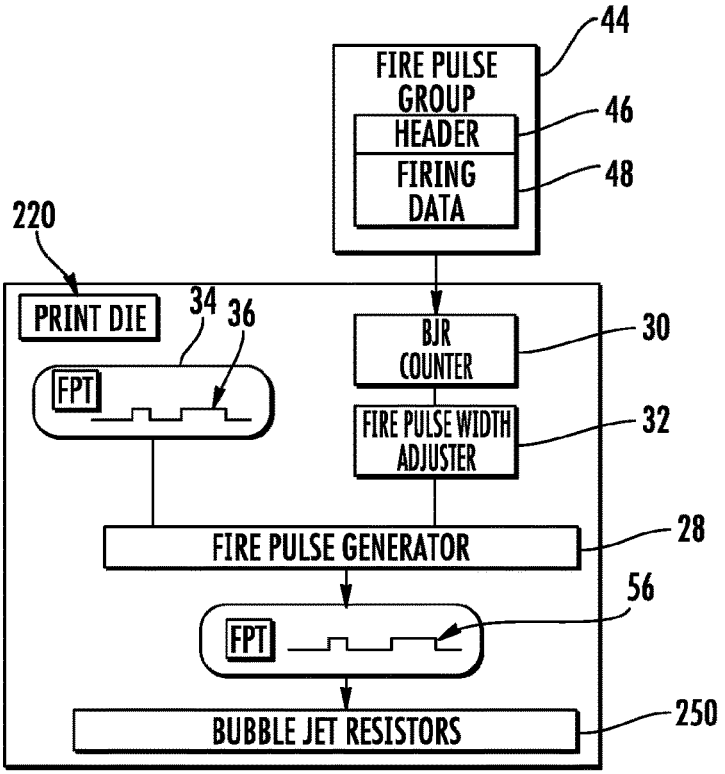
FIG. 3 is a schematic diagram of an example print die.

FIG. 3 schematically illustrates an example print die 220. Print die 220 may be utilized to eject drops of liquid onto a structure or substrate. In one implementation, print die 220 ejects liquid ink. In other implementations, print die 220 may eject other types of liquid. Print die 220 comprises fire pulse generator 28, bubble jet resistor counter 30 and pulse width adjuster 32, described above, fire pulse generator 240 and bubble jet resistors 250.

Bubble jet resistors 250 comprise sets of electrically conductive resistors adjacent to liquid fillable chambers so as to create a bubble to eject fluid through corresponding nozzle openings. In one implementation, bubble jet resistors 250 are arranged in columns along a liquid slot that supplies liquid to the liquid fillable chambers adjacent the bubble jet resistors 250. In other implementations, bubble jet resistors 250 may have other arrangements.

In operation, print die 220 receives the example fire pulse group 44. As described above, bubble jet resistor counter 30 counts the number of bubble jet resistors to be fired pursuant to fire pulse group 44. Fire pulse width adjuster 32 determines whether an adjustment should be made to the fire pulse of the default fire pulse train 36 based upon the number of bubble jet resistors to be fired. In one implementation in which multiple different levels of adjustment are available, fire pulse width adjuster 32 determines the extent of the adjustment that should be made based upon the number of bubble jet resistors to be fired. The determination of whether an adjustment should be made and possibly the determined extent of the adjustment is transmitted to fire pulse generator 28. Fire pulse generator 28 carries out the adjustment of the fire pulse by maintaining a first edge of the fire pulse relative to a precursor pulse while adjusting a second edge of the fire pulse relative to the precursor pulse. The adjusted fire pulse train 56 controls the supply of electrical current to bubble jet resistors 250, the electrical current being supplied in the form of electrical pulses having times and durations based upon the signals of fire pulse train 56.

Figure 4:
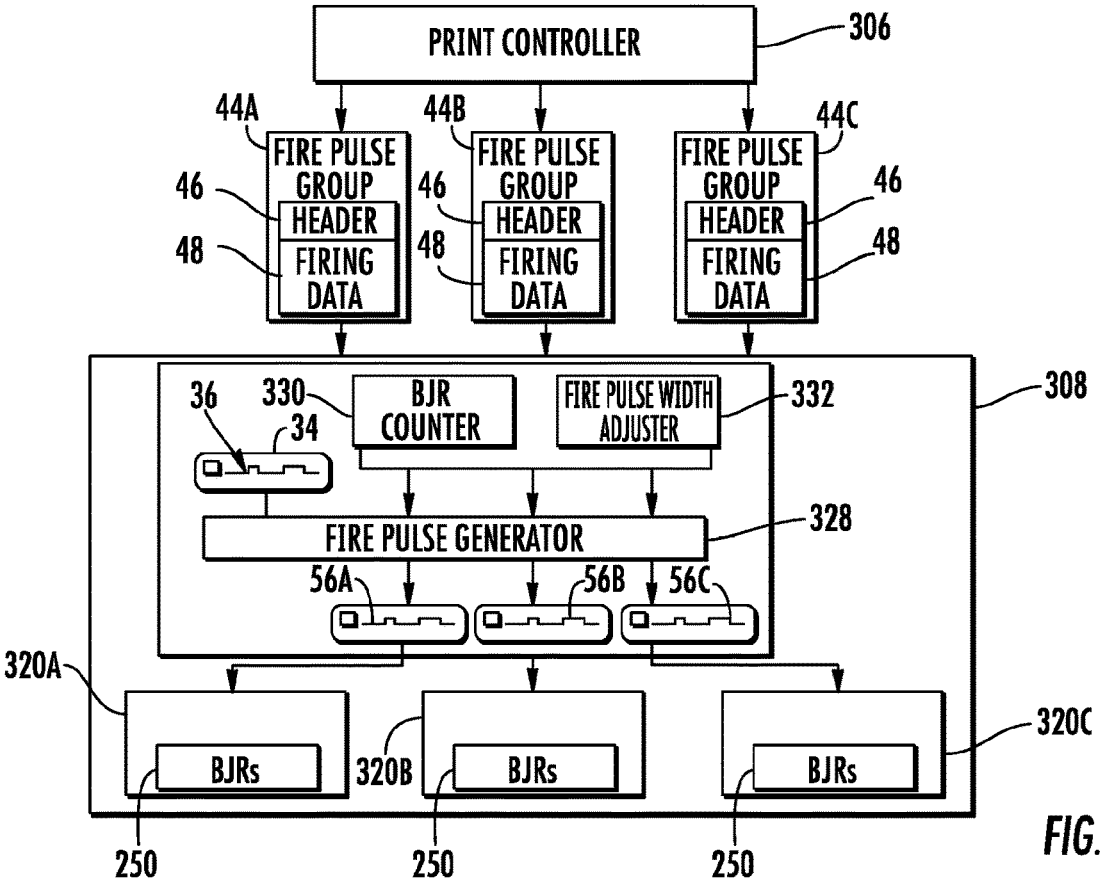
FIG. 4 is a schematic diagram of an example printer.

FIG. 4 schematically illustrates an example liquid ejection system or printer 304 selectively ejecting drops of liquid onto a substrate. In one implementation, printer 304 ejects liquid ink. In other implementations, printer 304 may eject other types of liquid. Printer 304 comprises print controller 306 and print bar 308.

Print controller 306 comprises electronics, such as a processing unit, that following instructions of a print job or executable print file, outputs electrical signals representing fire pulse groups 44A, 44B and 44C (collectively referred to as fire pulse groups 44) for the print head dies 320A, 320B and 320C, respectively. Each of fire pulse groups 44 comprises data serving as instructions for controlling what individual bubble jet resistors of the associated print die or other printing unit are to be concurrently fired at a particular moment in time. For purposes of this application, the term "processing unit" shall mean a presently developed or future developed firmware that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controller 306 may be embodied as part of one or more application-specific integrated circuits (ASICs). Unless otherwise specifically noted, the controller is not limited to any specific combination of hardware circuitry and software, nor to any particular source for the instructions executed by the processing unit.

Print bar 308 comprises a set of multiple individual printing units or dies 320A, 320B, 320C (collectively referred to as dies 320) under the control of a single fire pulse controller 360. Each of dies 320 comprise a set of bubble jet resistors 250 as described above. Unlike print die 220 described above, print dies 320 omit the counter 30, fire pulse width adjuster 32 and fire pulse generator 240, which are instead provided as part of fire pulse controller 360.

Fire pulse controller 360 controls the firing of each of print dies 320. In one implementation, fire pulse controller 360 comprises an integrated circuit, such as an application-specific integrated circuit (ASIC) or a field programmable gate array (FPGA). In another implementation, fire pulse controller 360 may additionally or alternatively comprise a processing unit, such as firmware, that carries out instructions provided as software in a non-transitory memory. Fire pulse controller 360 comprises fire pulse generator 328, bubble jet resistor (BJR) counter 330 and fire pulse width adjuster 332.

Fire pulse generator 328 is similar to fire pulse generator 28 described above except that fire pulse generator 328 is provided as part of controller 360 and supplies pulses of electrical current to each of print head dies 320A, 320B and 320C based upon the modified or adjusted fire pulse groups 44A, 44B and 44C, respectively.

Bubble jet resistor counter 330 is similar to bubble jet resistor counter 30 described above except that bubble jet resistor counter 330 comprises electronics that determines a number or count of bubble jet resistors to be fired pursuant to each fire pulse group 44 received from print controller 306 for each of print dies 320. Likewise, fire pulse width adjuster 332 is similar to fire pulse width adjuster 32 described above except that fire pulse width adjuster 332 comprises electronics that adjust the width of each fire pulse 40 for each bubble jet resistor for each of print dies 320. Fire pulse width adjuster 332 adjusts the width of each of the fire pulses 40 for a given fire pulse group for those bubble jet resistors 250 of print die 320A based upon the determined count of bubble jet resistors 250 to be fired pursuant to the given fire pulse group. Likewise, fire pulse width adjuster 332 adjusts the width of each of the fire pulses 40 for a given fire pulse group for those bubble jet resistors 250 of print die 320B based upon the determined count of bubble jet resistors 250 to be fired pursuant to the given fire pulse group for print die 320B and adjusts the width of each of the fire pulses 40 for a given fire pulse group for those bubble jet resistors 250 of print die 320C based upon the determined count of bubble jet resistors 250 to be fired pursuant to the given fire pulse group for print die 320C.

In one implementation, fire pulse width adjuster 332 may further adjust the widths of the fire pulses of a particular fire pulse group for a first print head die based upon the number or count of resistors to be fired by other print head dies of print bar 308 pursuant to their fire pulse groups at concurrent times. For example, in one implementation, fire pulse width adjuster 332 may adjust the width of the fire pulses 40 for those to be fired bubble jet resistors of fire pulse group 34A based upon (A) the number of bubble jet resistors to be fired pursuant to fire pulse group 34A and (B) the number of bubble jet resistors of die 320B to be fired pursuant to fire pulse group 34B and/or the number of bubble jet resistors of die 320C to be fired pursuant to fire pulse group 34C, wherein the bubble jet resistors fired pursuant to fire pulse groups 34A, 34B and 34C are fired at the same time. In such an implementation, the duration of the fire pulses for the bubble jet resistors to be fired pursuant to fire pulse group 34A may be reduced as the number of bubble jet resistors to be fired pursuant to fire pulse groups 34B and/or 34C becomes smaller or may be increased as the number bubble jet resistors to be fired pursuant to fire pulse groups 34B and/or 34C becomes larger.

Figure 5:
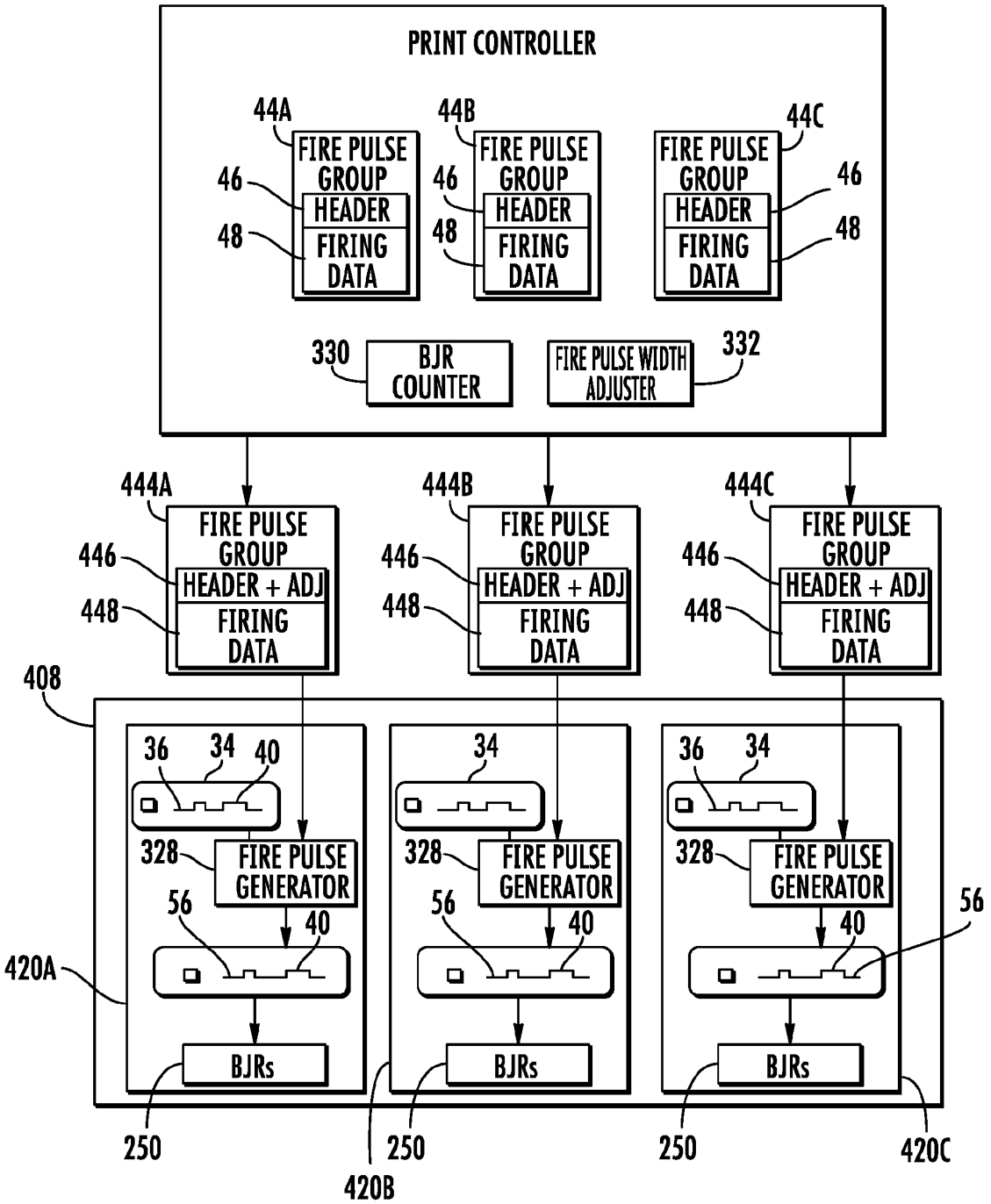
FIG. 5 is a schematic diagram of another example printer.

FIG. 5 schematically illustrates an example liquid ejection system or printer 404 selectively ejecting drops of liquid onto a substrate. In one implementation, printer 404 ejects liquid ink. In other implementations, printer 404 may eject other types of liquid. Printer 404 comprises print controller 406 and print bar 408.

Print controller 406 is similar to print controller 306 except the print controller 406 comprises bubble jet resistor counter 330 and fire pulse width adjuster 332 (described above). Bubble jet resistor counter 330 determines a count or number of bubble jet resistors to be fired pursuant to each fire pulse group. The example schematically illustrates three fire pulse groups 44A, 44B and 44C (collectively referred to as fire pulse groups 44) which comprise data to direct the firing of bubble jet resistors by individual print head dies of print bar 408. In the illustrated example, print counter 330 counts a number bubble jet resistors to be fired pursuant to fire pulse group 44A, the number bubble jet resistors to be fired pursuant to fire pulse group 44B and the number bubble jet resistors to be fired pursuant to fire pulse group 44C. In other implementations, print controller 406 may output greater than three fire pulse groups 44 for more than three print dies 420. In some implementations, print controller 406 may output less than three fire pulse groups for less than three print dies 420.

Fire pulse width adjuster 332 is described above. Fire pulse width adjuster 332 comprises electronics that adjust the width of each fire pulse 40 for each bubble jet resistor for each of print groups 44. Such adjustment of the width of each fire pulse is made by maintaining a first edge of each fire pulse relative to a precursor pulse and adjusting a second edge of each fire pulse relative to the precursor pulse based upon the determined count of bubble jet resistors to be fired pursuant to the fire pulse group.

As shown by FIG. 5, print controller 406 outputs adjusted firing pulse groups 444A, 444B and 444C (collectively referred to as fire pulse groups 444) for print head dies 420A, 420B and 420C, respectively, of print bar 408. Each fire pulse group 444 comprises a header 446 and firing data 448. The firing data 448 of each of fire pulse groups 444 is the same as the firing data 48 of the corresponding fire pulse group 44. For example, print data 448 of fire pulse group 444A, prescribing what bubble jet resistors are to be fired, is the same as firing data 48 of fire pulse group 44A.

Header 446 of each fire pulse group 444 is the same as the corresponding header 46 of the corresponding fire pulse group except that each header 446 additionally comprises data or bits indicating whether an adjustment should be made to the fire pulse 40 and, in some implementations, the determined extent of adjustment that should be made to the fire pulse 40. For example, headers 446 may each additionally comprise one or more data bits indicating an adjustment value for the fire pulses 40 prescribed by the default fire pulse train 36. For example, in one implementation, each header 446 may comprise three bits, indicating anyone of seven different levels or amounts of adjustment for the fire pulses 40 to be applied by the fire pulse generator 428 of each print die. In other implementations, each header 446 may comprise two bits or greater than three bits to provide other additional levels of pulse width adjustment.

Print bar 408 comprises a structure supporting a set of individual print dies, such as print dies 420A, 420B and 420C (collectively referred to as print dies 420). Each of print dies 420 comprises a fire pulse generator 428 and a set of bubble jet resistors 250 (described above). Each fire pulse generator 428 receives a corresponding fire pulse group 444 and controls the supply of electrical current to bubble jet resistors 250, the electrical current being supplied in the form of electrical pulses having times and durations based upon the signals of fire pulse group 44. In the example illustrated, fire pulse generator 428 adjusts the timing and duration of the fire pulses of its associated default fire pulse train 36 as dictated by the adjustment prescribed in header 446.

Figure 6:
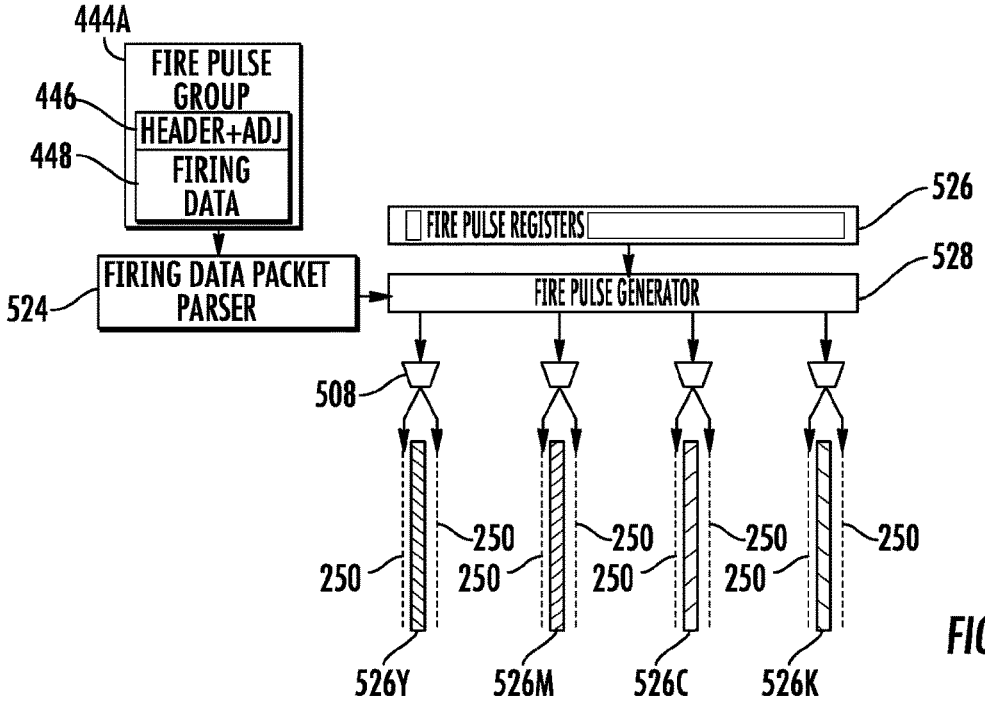
FIG. 6 is a schematic diagram of a portion of an example print die.

FIG. 6 schematically illustrates one example print die 520. Print die 520 may be utilized in or as part of any of the above described bubble jet devices, liquid ejection systems or printers. Print die 520 is to selectively eject or dispense different types of liquid. In the example illustrated, print die 520 facilitates ejection of four different types of liquid. In the example illustrated, print die 520 comprises columns of bubble jet resistors 250 (and associated nozzles) staggered along opposite sides of four liquid supply slots 526Y, 526M, 526C and 526K, with each different supply slots applying a different characteristic liquid. In one implementation, slots 526Y, 526M, 526C and 526K deliver or supply yellow, magenta, cyan and black liquid ink to their respective bubble jet resistors 250. In other implementations, die 520 may comprise a greater or fewer of such slots supplying the same or other types of liquid to bubble jet resistors 250.

As further shown by FIG. 6, print die 520 comprises a firing data packet parser 524, fire pulse registers 526 and fire pulse generator 528. Firing data packet parser 524 comprises electronics that receive pulse width group 444A (described above). Parser 500 parses out data from fire pulse group 444A. In the example illustrated, parser 500 reads the date of header 446, looking for the combination of bits indicating that the proceeding bits constitute the firing data 448, whereupon identifying such bits, parser 500 reads a firing data 448 to identify what particular bubble jet resistors are to be fired at the particular moment of time pursuant to the fire pulse group 444A. As will be described hereafter, parser 524 further reads header 446, looking for pulse width adjustment bits, to determine if the default fire pulse widths for the different types of liquid to be ejected by print die 520 should be adjusted, and in some implementations, the extent of the adjustment.

Fire pulse registers 526 comprise buffers that store default fire pulse trains for each of the different types of liquid to be ejected by the associated bubble jet resistors 250. For example, in one implementation, register 526 may store a first fire pulse train for use when ejecting a first type of liquid by a first set of bubble jet resistors and a second different fire pulse train for use when ejecting a second type of liquid, different than the first type of liquid, by a second set of bubble jet resistors. The different fire pulse trains may have differently timed precursor pulses 38, fire pulses 40 and/or dead times 42. The duration of a precursor pulse 38 and/or a fire pulse 40 may vary amongst the different fire pulse trains to accommodate the different characteristics of the different liquids. For example, one liquid may demand a greater amount of energy to be preheated or to be vaporized as compared to another type of liquid.

In the example illustrated, some liquids being ejected by some bubble jet resistors may have higher nucleation temperatures (the temperature to vaporize the particular liquid) as compared to other liquids ejected by other bubble jet resistors. As a result, the fire signals for bubble jet resistors that eject liquids having higher nucleation temperatures may have longer fire pulse durations. In the example illustrated, fire pulse registers 526 store a first default fire pulse train for the liquid supplied by slot 526Y, a second default fire pulse train for the liquid supplied by slot 526M, a third default fire pulse train for the liquid supplied by slot 526C and a fourth default fire pulse train for liquid supplied by slot 526K. Each of the default fire pulse trains may be different from one another based upon the different heating characteristics of the different liquids.

In the example illustrated, fire pulse registers 526 store or hold the timing of the edges of the precursor pulse 38 and the firing pulse 40 of each default fire pulse train 36 in the form of digital counts. In other implementations, fire pulse registers 526 may comprise other types of storage or buffering firmware.

Fire pulse generator 528 outputs electrical pulses of electrical current through respective multiplexers 508 to the bubble jet resistors 250 along the different slots 526Y, 526M, 526C and 526K pursuant to the stored default fire pulse train from registers 526 as further modified pursuant to the adjustment bits contained in the fire pulse group 444A.

Figure 7:
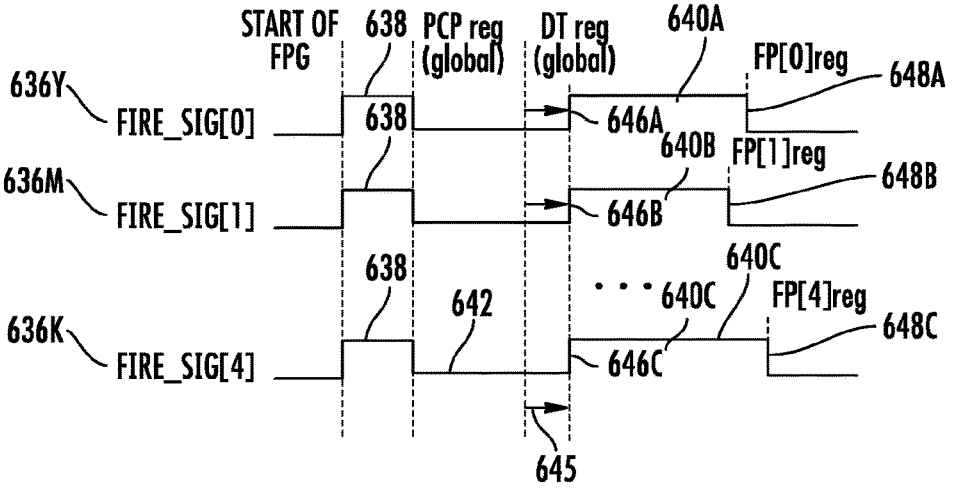
FIG. 7 is a diagram illustrating an example set of adjusted fire pulse trains for the print die of FIG. 6.

FIG. 7 illustrates a set of modified fire pulse trains 636Y, 636M and 636K (collectively referred to as fire pulse trains 636) that may be output by fire pulse generator 528 for bubble jet resistors to be fired pursuant to fire pulse group 444A. In the example illustrated, fire pulse trains 636Y, 636M and 636K are output by fire pulse generator 528 for the bubble jet resistors that eject liquid supplied by slots 526Y, 526M and 526K, respectively. Although not illustrated, an additional adjusted or modified fire pulse train may be output for the bubble jet resistors that eject liquid supplied by slot 526C. In the example illustrated, fire pulse trains 636Y, 636M and 636K are output by fire pulse generator 528 for the ejection of yellow, magenta and black ink, respectively. In other implementations, the ejection of yellow, magenta, cyan and black ink may be controlled using a single generally applicable fire pulse train or by less than four different fire pulse trains. In other implementations where other types of liquid are ejected, a greater or fewer of such different adjusted fire pulse trains may be output by fire pulse generator 528 for the different types of liquid being ejected by print die 520.

As shown by FIG. 7, each of such signals 636 comprise a precursor (PCP) 638, a fire pulse (FP) 640 and a soak or dead time (DT) 642. The width of each fire pulse 640 has been adjusted from the default width stored in registers 526 based upon the count or number of bubble jet resistors being fired as part of the particular fire pulse group 444A. As indicated by arrows 645, the leading-edge 646 of each fire pulse 640 has been adjusted relative to the precursor pulse 638 while the trailing edge 648 of each fire pulse 640 has been maintained relative to the associated precursor pulse 638. In the example illustrated, each of fire pulses 640 has the same leading-edge at the same start or initiation time. Each of leading-edges 646 is equally adjusted from the regular or "global" initiation time relative to precursor pulse 638, equally shortening the duration of each of fire pulses 640 while equally lengthening the dead time 642 of each of fire signals 636. Because all of the fire pulses 640 for all of the bubble jet resistors and all the fire signals 636 of the fire pulse trains 544 are adjusted in a similar or identical manner, execution of the multiple fire pulse adjustments is simpler and less costly, utilizing less processing bandwidth or less hardware. In particular, the adjustment may be indicated in the header 446 with fewer bits since a single set of bits may be used to indicate the adjustment level for all of different fire pulse trains.

Figure 8:
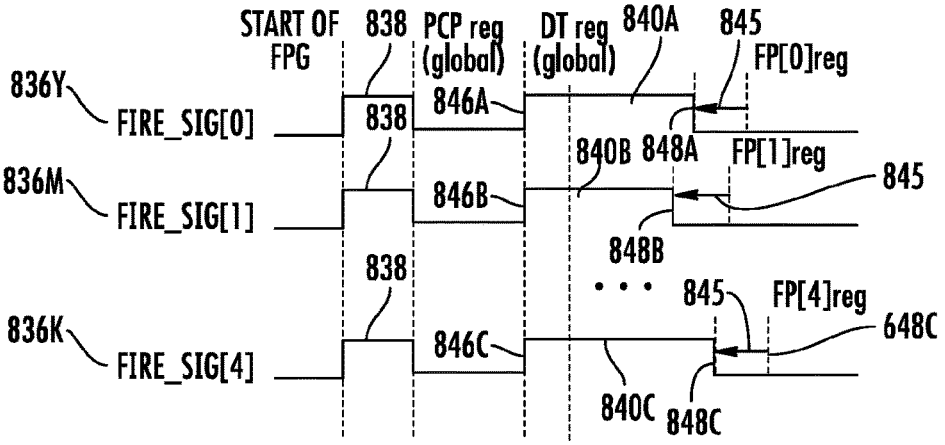
FIG. 8 is a diagram illustrating another example set of adjusted fire pulse trains for the print die of FIG. 6.

FIG. 8 illustrates a set of modified fire pulse trains 836Y, 836M, and 836K (collectively referred to as fire pulse trains 836). Each of such trains 836 comprises a precursor 838, a fire pulse 840 and a soak or dead time 842. The width of each fire pulse 840 has been adjusted based upon the count or number of bubble jet resistors being fired as part of the particular fire pulse group 444A.

Unlike the width of fire pulses 640 of adjusted fire pulse trains 636, the width of adjusted fire pulses 840 of adjusted fire pulse group 744 are adjusted by adjusting the trailing edges 848 relative to precursor pulses 838 while maintaining the timing or positioning of the leading edges 846 of fire pulses 840 relative to precursor pulses 838. As indicated by arrows 845, the trailing edge 848 of each fire pulses 640 has been moved back to an earlier time closer to precursor pulse 838, shortening the duration of the associated fire pulse 840. In the example illustrated, each of the fire pulses 840 is equally shortened by equally moving back in time the original trailing edge of the fire pulse 840. In the example illustrated, some liquids being ejected by some bubble jet resistors may have higher nucleation temperatures (the temperature to vaporize the particular liquid) as compared to other liquids ejected by other bubble jet resistors. As a result, the fire signals for bubble jet resistors that eject liquids having higher nucleation temperatures may have longer fire pulse durations, resulting in differently timed trailing edges 848 for some of the fire signals.

Although the present disclosure has been described with reference to example implementations, workers skilled in the art will recognize that changes may be made in form and detail without departing from the spirit and scope of the claimed subject matter. For example, although different example implementations may have been described as including one or more features providing one or more benefits, it is contemplated that the described features may be interchanged with one another or alternatively be combined with one another in the described example implementations or in other alternative implementations. Because the technology of the present disclosure is relatively complex, not all changes in the technology are foreseeable. The present disclosure described with reference to the example implementations and set forth in the following claims is manifestly intended to be as broad as possible. For example, unless specifically otherwise noted, the claims reciting a single particular element also encompass a plurality of such particular elements. The terms "first", "second", "third" and so on in the claims merely distinguish different elements and, unless otherwise stated, are not to be specifically associated with a particular order or particular numbering of elements in the disclosure.

What is claimed is:

1. An apparatus comprising:

a fire pulse generator to generate a fire pulse train for bubble jet resistors, the fire pulse train comprising a precursor pulse and a firing pulse separated by a dead time;

first electronics to determine a count of bubble jet resistors to be fired by a fire pulse group; and second electronics to adjust a width of the fire pulse for the bubble jet resistors of the fire pulse group by maintaining a first edge of the fire pulse relative to the precursor pulse and adjusting a second edge of the fire pulse relative to the precursor pulse based upon the determined count for the fire pulse group.

2. The apparatus of claim 1 further comprising a print controller, the print controller to generate the fire pulse group, wherein the print controller comprises the first electronics and the second electronics.

3. The apparatus of claim 2, wherein the fire pulse group generated by the print controller comprises data bits indicating the adjustment of the second edge of the fire pulse relative to the precursor pulse.

4. The apparatus of claim 1, wherein the second edge is a leading edge of the fire pulse.

5. The apparatus of claim 4, wherein the second electronics equally adjusts the leading edge of each fire pulse of the fire pulse group based upon the determined count for the fire pulse group.

6. The apparatus of claim 1, and the second edge is a trailing edge of the fire pulse.

7. The apparatus of claim 1 further comprising a print die, the print die comprising:

bubble jet resistors;

the fire pulse generator to generate the fire pulse train for the bubble jet resistors; and the first electronics and the second electronics, wherein the first electronics of the print die is to determine a count of bubble jet resistors to be fired pursuant to the fire pulse group and wherein the second electronics of the print die is to maintain the first edge of the fire pulse relative to the precursor pulse and adjust the second edge of the fire pulse relative to the precursor pulse based upon the determined count for the fire pulse group.

8. The apparatus of claim 1 further comprising circuitry, the circuitry comprising:

a fire pulse generator to generate fire pulse trains for bubble jet resistors of each of a plurality of print dies; and the first electronics and the second electronics, wherein the first electronics of the circuitry is to determine a count of bubble jet resistors to be fired pursuant to the fire pulse group and wherein the second electronics of the circuitry is to maintain the first edge of the fire pulse relative to the precursor pulse and adjust the second edge of the fire pulse relative to the precursor pulse based upon the determined count for the fire pulse group.

9. The apparatus of claim 1, wherein the fire pulse width is determined based upon the determined count for the fire pulse group by the second electronics by a determination protocol selected from a group of determination protocols consisting of: applying a non-linear equation based upon the determined count; consulting a lookup table based upon the determined count; and inputting two points in a register space to apply a linear equation based upon the determined count.

10. The apparatus of claim 1, wherein the adjustment of the second edge of the fire pulse for the fire pulse group for a first print die is based upon the determined count for bubble jet resistors to be fired pursuant to the fire pulse group for the first print die and a second determined count of bubble jet resistors to be fired by a second print die pursuant to a second fire pulse group for the second die.

11. The apparatus of claim 1, wherein the count of bubble jet resistors to be fired by the fire pulse group is a number of bubble jet resistors to be concurrently fired at a moment in time.

12. The apparatus of claim 1, wherein the width of the fire pulse is adjusted by the second electronics based upon the determined count for the fire pulse group so as to compensate for parasitic losses resulting from concurrent firing of the bubble jet resistors.

13. A method comprising:

determining a count for a number of bubble jet resistors to be fired in a fire pulse group; and adjusting a width of the fire pulse of a fire pulse train for bubble jet resistors of the fire pulse group by maintaining a first edge of the fire pulse relative to a precursor pulse and adjusting a second edge of the fire pulse relative to the precursor pulse based upon the determined count for the fire pulse group.

14. The method of claim 13, wherein the counting of the number of bubble jet resistors to be fired in the fire pulse group is determined by print controller and wherein the print controller indicates the fire pulse width for the fire pulse group in a header of the fire pulse group output by the print controller.

15. The method of claim 13, wherein the width of the fire pulse of the fire pulse group for a first print die is adjusted based upon the determined count of bubble jet resistors to be fired by the first die pursuant to a first fire pulse group and based upon a determined count of bubble jet resistors to be fired by a second die pursuant to a second fire pulse group.

16. The method of claim 13, wherein the count of bubble jet resistors to be fired by the fire pulse group is a number of bubble jet resistors to be concurrently fired at a moment in time.

17. The method of claim 13, wherein the width of the fire pulse is adjusted based upon the determined count for the fire pulse group so as to compensate for parasitic losses resulting concurrent firing of the bubble jet resistors.

18. An apparatus comprising:

a print controller to:

determine a count of bubble jet resistors to be fired in a fire pulse group;

determine a width adjustment for a fire pulse of each bubble jet resistor to be fired pursuant to the determined count for the fire pulse group; and provide a header in the fire pulse group digitally indicating the determined width adjustment of the fire pulse for each of the bubble jet resistors to be fired in the fire pulse group.

19. The apparatus of claim 18, wherein a fire pulse generator is to generate a fire pulse train for each bubble jet resistor to be fired pursuant to the fire pulse group, the fire pulse train comprising a precursor pulse and a firing pulse separated by a dead time and wherein the width adjustment for the fire pulse of each bubble jet resistor to be fired pursuant to the fire pulse group comprises maintaining a first edge of the fire pulse relative to the precursor pulse and adjusting a second edge of the fire pulse relative to the precursor pulse based upon the determined count for the fire pulse group.

20. The apparatus of claim 18, wherein the count of bubble jet resistors to be fired by the fire pulse group is a number of bubble jet resistors to be concurrently fired at a moment in time.

* * * * *